US007107184B2

(12) United States Patent
Gentile et al.

(10) Patent No.: US 7,107,184 B2
(45) Date of Patent: Sep. 12, 2006

(54) STRATEGIES FOR ANALYZING PUMP TEST RESULTS

(75) Inventors: Philip E. Gentile, Sunbury, OH (US); Todd A. Dillon, Lakewood, OH (US); Jose Juan Ordinas-Lewis, Tolland, CT (US)

(73) Assignee: ERC, Overland Park, KS (US)

( * ) Notice: Subject to any disclaimer, the term of this patent is extended or adjusted under 35 U.S.C. 154(b) by 0 days.

(21) Appl. No.: 10/992,023

(22) Filed: Nov. 18, 2004

(65) Prior Publication Data

US 2006/0106575 A1 May 18, 2006

(51) Int. Cl.
*G06F 11/32* (2006.01)

(52) U.S. Cl. ..... 702/182; 73/865.9; 417/63

(58) Field of Classification Search ..... None
See application file for complete search history.

(56) References Cited

U.S. PATENT DOCUMENTS

| | | | | |
|---|---|---|---|---|
| 4,643,224 | A | 2/1987 | Rung et al. | |
| 4,798,086 | A * | 1/1989 | Styfhoorn | 73/168 |
| 5,320,138 | A | 6/1994 | Ferlitch, Jr. | |
| 5,680,329 | A * | 10/1997 | Lloyd et al. | 700/275 |
| 6,085,585 | A | 7/2000 | Yu et al. | |
| 6,330,525 | B1 * | 12/2001 | Hays et al. | 702/183 |
| 6,491,056 | B1 | 12/2002 | Gibb | |
| 6,591,697 | B1 * | 7/2003 | Henyan | 73/861.71 |
| 6,721,683 | B1 * | 4/2004 | Harris et al. | 702/183 |
| 2002/0083982 | A1 | 7/2002 | Gibb | |
| 2003/0091443 | A1 * | 5/2003 | Sabini et al. | 417/53 |
| 2003/0154763 | A1 | 8/2003 | Cain | |
| 2004/0158419 | A1 * | 8/2004 | Pearson et al. | 702/64 |

OTHER PUBLICATIONS

Huggins, R., "Technical Articles: Sizing Fire Pumps, Using the Pump Curve," [online], [retrieved on Feb. 1, 2005], retrieved from the Internet at URL: <http://www.sprinklernet.org/technical/articles/020410sz_frpmp.html>, 4 pages.

"Fire Pumps," Factory Mutual Research, [online], posted Apr. 2, 2001, [retrieved on Feb. 1, 2005], retrieved from the Internet at URL:<http://www.pmengineer.com/CDA/ArticleInformation/features/BNP_Features_Item/0,2732,24053,00.html>.

Roy, M., "Selecting Fire Pumps for ESFR Sprinkler Application," [online] posted Feb. 28, 2002, [retrieved on Feb. 1, 2005], retrieved from the Internet at URL: http://www.pmmag.com/CDA/ArticleInformation/features/BNP_Features_Item/0,2379,72908,00.html>, 6 pages.

Gray, T., "Testing and Maintenance of Fire Pumps," [online], posted Apr. 24, 2001, [retrieved on Feb. 1, 2005], retrieved from the Internet at URL: <http://www.pmengineer.com/CDA/ArticleInformation/features/BNP_Features_Item/0,2732,24866,00.html>, 5 pages.

(Continued)

*Primary Examiner*—Marc S. Hoff
*Assistant Examiner*—Manuel L. Barbee
(74) *Attorney, Agent, or Firm*—Lee & Hayes, PLLC

(57) ABSTRACT

Strategies are described for analyzing test data received from tests performed on a fire pump, and then automatically computing an overall grade (e.g., excellent, good, fair, or poor) which reflects how the analyzed test data compares with reference data. A standard curve or a manufacturer's curve can serve as the baseline reference data. The output grades can be conveyed in tabular form or graphical form. In the graphical form, the analyzed test data can be plotted for comparison with plural reference curves, where the reference curves demarcate ranges associated with the possible grades.

44 Claims, 9 Drawing Sheets

OTHER PUBLICATIONS

Smith, B., "Computerizing Fire Sprinkler Hydraulic Calculations," [online], [retrieved on Oct. 30, 2004], retrieved from the Internet at URL: <http://www.elitesoft.com/web/newsroom/hycalcs.htm>, 4 pages.

Fire Pump Monitoring System provides diagnostic information, Armstrong Pumps Inc., [online], posted Apr. 28, 2004, [retrieved on Oct. 3, 2004], retrieved from the Internet at URL: <http://news.thomasnet.com/fullstory/451094>, with attached product brochure regarding Armstrong Series 4900F Fire Pump Monitoring Systems accessible at <http://www.armstrongpumps.com>, 5 pages total.

"NFPA Overview- FPE Software, Inc. Fire Pump and Sprinkler Software," [online] posted Jul. 3, 2003, [retrieved on Oct. 3, 2004], retrieved from the Internet at URL: <http://www.pmmag.com/CDA/ArticleInformation/features/BNP__Features__Item/0,2379,103229,00.html>, 1 page.

"Fire Pump Evaluation Program 2002," FPE Software, Inc., materials from website, [online], [retrieved on Oct. 3, 2004 and Feb. 1, 2005], retrieved from the Internet at URL: <http://www.fpesoftware.com/fpep%202002%20features.html>, 7 pages.

"Fire Sprinkler Hydraulic Calculations and Hydrant Flow Testing," Fire Sprinkler Hydraulics Software, [online], retrieved on Oct. 3, 2004, (retrieved from the Internet at URL: <http://www.mindspring.com/-hydronics/>, 9 pages.

"NFPA 20: Standard for the Installation of Stationary Pumps for Fire Protection," 2003 Edition, NFPA, Quincy, Massachusetts, pp. 20-21 through 20-86.

* cited by examiner

Standard Curve Value

| | | | | | | | | | | | |
|---|---|---|---|---|---|---|---|---|---|---|---|
| Account: 302 | ABC Industries | Pump ID 310 | Diesel | Rated Flow: 320 | 1,500 | Rated Pressure: 322 | 100 | Rated Speed: 324 | 1760 | Suction Size(in.): 328 | 8 |
| Location: 304 | Syracuse, NY | Date: 316 | 11/25/2005 | Model: 312 | | | S.N. 314 | | | Discharge Size(in.): 330 | 8 |
| Location ID: 306 | 123456/777555 | Notes: 318 | Problem making 150% test reading . . . | | | | Rated psi at 150% Flow: 326 | | 65 | | |

| | Loss Prevention Consultant 308 | Flowing Outlet I.D. 338 | Cd 340 | Pitot Readings (psi) 342 | | | | | | | | | Flow Meter (gpm) 344 | Comb. Flow (gpm) 346 | Pressure: Suction (psi) 348 | Pressure: Discharge (psi) 350 | Vel. Head Corr. 352 | Net Press 354 | Pump Speed (rpm) 356 | Correction to Rated Speed: Flow (gpm) 358 | Correction to Rated Speed: Pressure (psi) 360 | Data Point Rating 362 | FINAL PUMP RATING 364 |
|---|---|---|---|---|---|---|---|---|---|---|---|---|---|---|---|---|---|---|---|---|---|---|---|
| 332 | 1.75 | 0.97 | 0 | | | | | | | | | | | 0 | 12 | 125 | 0.0 | 113 | 1798 | 0 | 108 | NA | |
| 334 | 1.75 | 0.97 | 32 | 32 | 32 | | | | | | | | | 1,505 | 11 | 102 | 0.0 | 91 | 1754 | 1,510 | 92 | 2-Fair | 2-Fair |
| 336 | 1.75 | 0.97 | 24 | 30 | 30 | 38 | | | | | | | | 1,952 | 10 | 84 | 0.0 | 74 | 1746 | 1,968 | 75 | 3-Good | |

Data Input Section 224

Overall Grade

Fig. 3

| | (gpm) | (psi) |
|---|---|---|
| Pump Ratings | 0 | 120 |
| 100% Rating | 1500 | 100 |
| 150% Rating | 2500 | 65 |
| Excellent Curve ■ | 0 | 120 |
| | 1500 | 105 |
| | 2250 | 68.25 |
| Poor Curve * | 0 | 120 |
| | 1500 | 90 |
| | 2250 | 58.5 |
| Good Curve ▲ | 0 | 120 |
| | 1500 | 100 |
| | 2250 | 65 |
| Fair Curve ● | 0 | 120 |
| | 1500 | 95 |
| | 2250 | 61.75 |

402

Tabular Results Seciton 226

404

Key

| | 100% Point | 150% Point |
|---|---|---|
| 4-Excellent | 105% | 105% |
| 3-Good | 100% | 100% |
| 2-Fair | 95% | 95% |
| 1-Poor | 90% | 90% |

406

| % Rated gpm (408) | Est % Rated psi (410) | Est psi (412) | % of psi (414) | Rating 5% (416) | Overall Rating (418) |
|---|---|---|---|---|---|
| 0.00 | 1.70 | 170.00 | -0.36 | NA | 2-Fair |
| 1.01 | 1.00 | 99.53 | -0.08 | 2-Fair | |
| 1.31 | 0.78 | 78.16 | -0.04 | 3-Good | |

Fig. 4

STRATEGIES FOR ANALYZING PUMP TEST RESULTS

TECHNICAL FIELD

This invention relates to strategies for analyzing pumps, and, in a more particular implementation, to strategies for analyzing fire pumps using data processing equipment.

BACKGROUND

Facilities use fire pumps to provide water to sprinkler systems in the event of a fire. The fire pumps maintain a desired level of water pressure by either boosting the water pressure of a public supply of water, or by working in conjunction with a private supply of water maintained by a facility.

Pumps come in a variety of designs and sizes. Fire pumps are generally driven either by an electric power supply or a diesel power supply. Common respective pump sizes will generate 1000 gallons per minute (gpm), 1500 gpm, 2000 gpm, 2500 gpm, and greater. For example, the National Fire Protection Agency (NFPA) specification entitled, "NFPA 20: Standard for the Installation of Stationary Pumps for Fire Protection," (2003 Edition, 1 Batterymarch Park, Quincy Mass.), sets forth that fire pumps can have ratings between 25 gpm and 5000 gpm at set flow capacities (e.g., 25 gpm, 50 gpm, 100 gpm . . . 4000 gpm, 4500 gpm, 5000 gpm). The pressure of different pumps can likewise vary. For example, the minimum pump rating set forth in NFPA 20 is 40 pounds per square inch (psi), but there is no maximum pressure. A manufacturer will design the pump to perform at a "rated" flow, pressure and speed.

In addition, a manufacturer will ensure that the fire pump satisfies a so-called standard curve. The standard curve mandates that the pump at least: (a) perform at a certain percent of the rated pressure when there is zero flow being emitted from the pump (know as a "churn" state) (for example, as per NFPA 20, churn pressure can be any pressure between 100% and 140% of rated pressure); (b) perform at 100 percent of the rated flow at 100 percent of the rated pressure; and (c) perform at 150 percent of the rated flow at 65 percent of the rated pressure. The standard curve can therefore be characterized by these three data points. In addition, a manufacturer will furnish a detailed manufacturer's curve, which identifies the specific performance of the fire pump. That is, the actual pump supplied to a customer may exceed the baseline requirements of the standard curve in various respects, which are identified by the manufacturer's curve.

Because fire pumps often protect resources of considerable value, the fire pumps are periodically performance-tested to make sure that they are working properly. A thorough acceptance test is first performed on a fire pump when it is installed in a facility. The fire pump is thereafter performance-tested on an annual basis to make sure that it continues to operate properly. The annual tests will entail assessing the fire pump's performance at three points of operation defined by the standard curve. Namely, a first test will operate the fire pump at zero flow and at a certain percentage of the rated pressure; a second test will operate the fire pump at about 100 percent of the rated flow which should optimally achieve at least 100 percent of the rated pressure; and a third test will operate the pump at about 150 percent of the flow which should optimally achieve at least 65 percent of the rated pressure. Various measurements are taken at these three points of operation to collect test data.

The performance of the pump is then assessed by relying on a human to manually compare the test data to the pump's expected performance. As mentioned above, the expected performance of the fire pump is reflected by the standard curve, or more preferably, by the manufacturer's curve (if it exists). Pumps may fail (or generally degrade in performance) for any number of reasons, such as friction-related wear of the bearings, wear of the impeller or casing used in the fire pump, obstructions in the pump casing, shaft misalignment, worn wear rings, and so forth.

However, the above-described manual technique of analyzing test data can lead to erroneous results. For instance, even a skilled evaluator may fail to recognize certain problems with the fire pump (as assessed against its expected performance). These errors can result when the evaluator misreads the test data. But a more pervasive problem is due to the general difficultly in consistently making accurate pass-fail type decisions, which characterize the often complex and multi-faceted behavior of the pump. These errors can result in assessing the pump's performance as satisfactory, when it really should be graded as unsatisfactory. Or the errors may result in assessing the pump's performance as unsatisfactory, when it really should be graded as satisfactory. The former case is obviously of substantial concern, as the poor performance of a fire pump in the event of an actual fire can lead to significant loss of resources in a facility.

There is accordingly a need in the art to provide more reliable and convenient tools for assessing the performance of fire pumps. While the following disclosure is directed to the concrete examples of fire pumps, the solutions presented herein can also be applied to other kinds of pumps. Moreover, while the following disclosure is framed in the specific contexts of standards applicable to pumps deployed in the United States, the solutions presented herein can also be applied to pumps manufactured and deployed in foreign countries, with appropriate modification of relevant parameters.

SUMMARY

According to one exemplary implementation, a method is described for analyzing the performance of a pump, comprising: (a) receiving test data that reflects a test performance of the pump during a test; (b) receiving reference data that reflects a reference performance of the pump; (c) performing computations on the test data to generate actual performance data; (d) comparing the actual performance data against the reference data to provide at least one comparison result; (e) automatically assigning a grade to the pump based on the above-mentioned at least one comparison result; and (f) presenting information regarding the assigned grade to a user.

Additional implementations and features will be described in the following.

BRIEF DESCRIPTION OF THE DRAWINGS

FIGS. 3–5 describe exemplary user interface presentations that can be used by the electronic device of FIG. 2 to interact with pump analysis logic.

Figure 1:
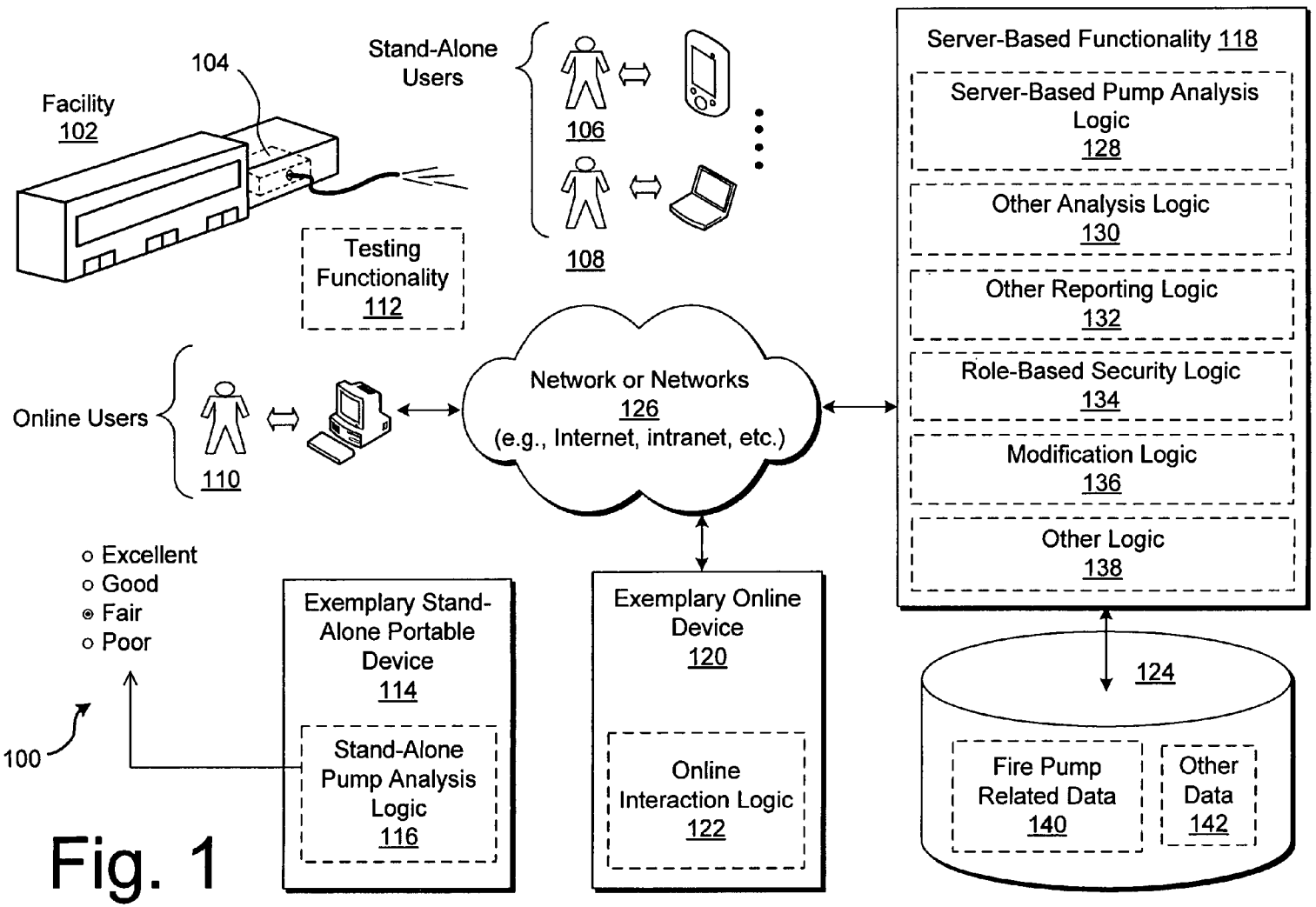
FIG. 1 shows an exemplary system for automatically analyzing the performance of a fire pump.

The same numbers are used throughout the disclosure and figures to reference like components and features. Series 100 numbers refer to features originally found in FIG. 1, series 200 numbers refer to features originally found in FIG. 2, series 300 numbers refer to features originally found in FIG. 3, and so on.

DETAILED DESCRIPTION

One strategy described herein provides a unique means for analyzing test data that reflects the performance of a pump during a test. The analysis involves performing computations on the test data to generate actual performance data, and then comparing this performance data with reference data to automatically assign a grade to the pump (of excellent, good, fair, or poor). This strategy has several advantages over known techniques (which involve the "manual" assessment of test data). For example, the automated analysis described herein potentially provides more accurate and consistent results than the known manual techniques. This, in turn, leads to more reliable identification of problems in the pump, which, if corrected, may reduce the potential that the pump will fail when it is needed.

Another strategy described herein provides a unique means for determining the grading of the pump. The strategy involves providing an equation that represents a reference curve associated with the reference data. The strategy uses the reference curve to determine expected performance data that describes how the pump should have performed during the test. The strategy determines the grading by comparing the expected performance data with the actual performance data. The reference data used to compute the reference curve can be based on either a standard curve or a more pump-specific manufacturer's curve. This strategy has various advantages over known techniques. For instance, by providing a mechanism for incorporating either a standard curve or a manufacturer's curve as baseline reference data, this technique provides highly accurate assessments of pump degradation.

Another strategy described herein provides a unique means for visualizing the performance of the pump vis-à-vis the reference data. The strategy comprises presenting plural reference curves, which represent plural respective deviations from the reference data, and then plotting the actual performance data relative to the plural reference curves. Namely, the strategy can comprise presenting an excellent reference curve, a good reference curve, a fair reference curve, and a poor reference curve, and then presenting a performance curve, which reflects the actual performance of the pump during the test. The positioning of the performance curve relative to the reference curves provides a convenient visual means for grading the pump with respect to each of a plurality of data points. The strategy can provide an overall grade based on the lowest grade assigned to any of the graded data points. The strategy can also provide explicit alpha-numeric information, which identifies the overall grade.

Additional features and attendant benefits of the strategies will be set forth in this description.

As to terminology, the term "test data" is used herein to refer to any data collected during a test of the pump. Such data may reflect readings from testing equipment brought to the test, readings from various meters integrated with the pump, parameters pertaining to various settings that govern the performance of the tests, and so forth.

The term "reference data" is used herein to refer to any information against which the test data can be compared. Exemplary forms of reference data include information that characterizes the rated performance of the pump, information that characterize the standard curve, and/or information that characterize the manufacturer's curve (if it is available).

The term "actual performance data" is used herein to refer any information that can be computed based on the test data that reflects how the pump performed during the test. On the other hand, the term "expected performance data" is used herein to refer to any information that reflects how the pump should have performed during the test, based on the reference data defined above.

The term "comparison result" as used herein refers to any comparison of the actual performance data with the reference data (such as the expected performance data).

The term "grade" as used herein refers to any kind of assessment of the pump's performance using any kind of multi-level evaluation scheme. The grade is based on the comparison result.

Generally, as to the structural aspects of the described subject matter, any of the functions set forth herein can be implemented using software, firmware (e.g., fixed logic circuitry), manual processing, or a combination of these implementations. The terms "module," "functionality," and "logic" as used herein generally represents software, firmware, or a combination of software and firmware. In the case of a software implementation, the term module, functionality, or logic represents program code that performs specified tasks when executed on a processing device or devices (e.g., CPU or CPUs). The program code can be stored in one or more fixed and/or removable computer readable memory devices.

As to the procedural aspects of this subject matter, certain operations are described as constituting distinct steps performed in a certain order. Such implementations are exemplary and non-limiting. Certain steps described herein can be grouped together and performed in a single operation, and certain steps can be performed in an order that differs from the order employed in the examples set forth in this disclosure.

This disclosure includes the following sections: Section A sets forth an exemplary system for implementing the analysis of pump test data. Section B sets forth an exemplary electronic apparatus for use within the system of Section A. Section C sets forth exemplary user interface functionality (and associated underlying computer analysis) for use in interacting with the electronic apparatus of Section B. And Section D sets forth exemplary procedures (in flowchart form) for automatically analyzing pump test data using the functionality set forth in prior sections.

A. Exemplary System

FIG. 1 shows a system 100 for performing tests on a pump to generate test data, and for analyzing the test data to automatically grade the pump as excellent, good, fair, or poor (according to one exemplary and non-limiting grading scheme). To provide concrete examples, the following example is set forth in the context of the testing and analysis of fire pumps. Fire pumps are pumps that supply water to sprinkler systems and/or fire hoses in the event of a fire at a facility. The analysis tools described herein are applicable to any type of fire pump (e.g., diesel, electric, etc.), as well as any size of fire pump (e.g., as reflected by its rated performance). A comprehensive discussion of the structure and performance of fire pumps is provided in the above-referenced NFPA 20 specification, which is incorporated by reference herein in its entirety.

In addition, the analysis tools described herein are applicable to other types of pumps besides fire pumps. Further, the analysis tools described herein are also applicable to pumps manufactured and/or installed in foreign countries (i.e., outside the United States). Application of the principles described herein can be adapted to such "foreign" pumps and other pump types by modifying the standard-related assumptions described herein to conform to whatever standards apply to such pumps.

The logical starting point in describing the system 100 is with the testing itself. FIG. 1 shows an exemplary facility 102 including at least one fire pump 104 associated therewith. The facility 102 can span the gamut of structures, such as a manufacturing facility, apartment complex, educational building, airport hanger, and so on. Individuals associated with the facility 102 may conduct the test themselves. Alternatively, those associated with the facility 102 may entrust someone else to conduct the test on their behalf; for instance, various contract engineers or insurance consultants may be entrusted to perform or supervise the tests. In general, the person who performs the test may be the same person who performs the analysis using the tools described herein. For example, in one particular scenario, for instance, a risk consultant may visit the facility 102 to perform both the test and the analysis. The risk consultant may than present the grading results to the client at the facility 102 as a vehicle for discussing any problems that were discovered and any steps that should be taken to rectify the problems. Alternatively, the person who performs the test may simply supply test data for later use by another person who actually conducts the analysis. In general, the individuals 106, 108, and 110 represent a sample of a large group of actors who may be involved in the testing and analysis to be described below.

As to the test itself, an acceptance test is performed when the fire pump 104 is first installed at the facility 102. The acceptance test is typically a relatively comprehensive test. The purpose of the acceptance test is to ensure that the fire pump 104 performs in the facility 102 in the manner promised by the manufacturer of the fire pump 104. Thereafter, periodic (e.g., annual) performance tests are performed on the fire pump 104 to ensure that it continues to operate correctly.

As described in the Background section, testing can involve flow tests. Flow tests involve collecting test data while the fire pump is operating in at least three distinct states. In a first phase, test data is collected in a churn state, where the fire pump is not flowing any water and is expected to operate at a prescribed percentage of its rated pressure. In a second phase, test data is then collected at 100 percent of the rated flow to optimally achieve at least 100 percent of the rated pressure. In a third phase, test data is collected (if possible) at 150 percent of the rated flow to optimally achieve at least 65 percent of the rated pressure. These three operational states correspond to the three data points, which define the standard curve. Again, the standard curve is a baseline curve, which defines the minimum threshold requirements of all pumps. Operational characteristics more specific to a particular fire pump can be gleaned from a manufacturer's curve. A manufacturer's curve will typically plot the performance of its pump using more than three points.

The testing procedure can vary depending on the fire pump 104 being testing and other factors. A typical testing regimen will involve hooking fire hoses with an attached so-called "underwriters" play pipe up to a special fire pump test header and then running water through the hoses at the approximate 100 percent flow state and then at the approximate 150 percent flow state. Flow measurements can be collected using known testing functionality 112, such as an instrument called a pitot tube. The pitot tube measures nozzle pressure in an open stream of water from the end of the "underwriters" play pipes. Using standard hydraulic characteristics, the measured pitot tube pressure can be entered into a standard hydraulic calculation to determine a flow rate in gallons per minute (gpm) at any nozzle diameter and pitot pressure. Some pump installations also include integrated flow meters. Test data can be collected from these meters when it is not possible to flow water through the hoses and collect flow data using pitot-based instruments (e.g., because of cold weather or other factors). Other pressure readings, such as the suction pressure and discharge pressure, which are taken from gauge ports on the suction and discharge sides of the pump, can be determined within the pump house to assess the performance of the pump. The suction and discharge pressure gauges read directly in pounds per square inch (psi).

After performing the tests and collecting the data, the analysis begins. FIG. 1 shows two scenarios that can be used to conduct analysis. In a first scenario, various users (e.g., users 106, 108) can operate electrical devices that provide analysis in a stand-alone mode. That is, the analysis is stand-alone in the sense that it is performed locally by the electrical devices (e.g., without the need for interacting with functionality provided by a remote processing site). Exemplary forms of stand-alone devices can include any kind of stationary general purpose computer, any kind of portable general purpose computer (e.g., lap top computer), a personal digital assistant (PDA), any kind of tablet type of computing device, any kind of wearable computer device, and so forth. Alternatively, a special purpose computing device can be configured to perform the sole task of performing fire pump analysis (e.g., which may incorporate a specifically tailored ASIC unit to perform the analysis functions described below). More generally, as will be described below in connection with FIG. 2, any of these stand-alone devices may include conventional computer hardware, such as one or more processing devices (CPUs), RAM memory, ROM memory, various disc storage units, various interface functionality, various input and output functionality, and so forth.

FIG. 1 shows one exemplary stand-alone device 114. It includes stand-alone pump analysis logic 116. This pump analysis logic 116 performs all of the pump-related analysis tasks to be described below. The pump analysis logic 116 can be implemented by firmware and/or software and/or a combination of firmware. As illustrated in FIG. 1, one of the principal output results of the analysis logic 116 is a grading of the pump 104's performance. Exemplary grades include excellent, good, fair, and poor. This output result can be presented in both alpha-numeric form and graphical form.

In a second scenario, various other users (e.g., user 110) can operate electrical devices that provide analysis in an online mode. That is, the analysis is online in the sense that the analysis is performed by the electrical devices using the functionality provided by a remote processing site, such as server-based functionality 118. Exemplary forms of online devices can also include any of the devices mentioned above with respect to the stand-alone units.

FIG. 1 shows an exemplary online device 120. It includes online interaction logic 122. The online interaction logic 122, together with the server-based functionality 118, implements the pump-related analysis tasks to be described below. More specifically, processing functionality can be split between the online interaction logic 122 and the server-based functionality 118 in any manner. In one case, the functionality used to perform the analysis tasks are divided between the online interaction logic 122 and the server-based functionality 118, with each of these units sharing some of the processing responsibility. In another case, the online interaction logic 122 includes functionality that enables it to access the server-based functionality 118, but does not itself locally perform any of the pump-related analysis tasks. In this case, the server-based functionality 118 performs all of the pump-related analysis when requested by the online device 120, and supplies the output results to online device 120 for presentation to a user who is interacting with the online device 120.

The server-based functionality 118 can be implemented as one or more server computers (e.g., such as a farm of server computers). A server computer is a computer device with software and/or hardware dedicated to processing and responding to the requests of the computer devices (e.g., online device 120). Any kind of server platform can be used. Although shown as localized at a single site for convenience of illustration, certain aspects of the server-based functionality 118 can be distributed over plural sites.

The server-based functionality 118 can interact with a database 124 (or plural databases). The database 124 can include any collection of physical storage units, representing silicon storage devices, optical storage devices, magnetic storage devices, etc. The database 124 can also include dedicated processing functionality, such as a dedicated server, for maintaining the data stored therein. This dedicated processing functionality can use any kind of storage technique, such as Structured Query Language (SQL). Various known commercial products can be used to implement the database 124, such as various data storage solutions provided by the Oracle Corporation of Redwood Shores, Calif. The database 124 can be located at a single site, or spread over plural sites in a distributed fashion.

A network 126 can be used to couple the online devices (e.g., device 120) with the sever-based functionality 118. The network 126 can be implemented using a wide area network (WAN) governed by the Transmission Control Protocol and the Internet Protocol (TCP/IP). For instance, this network 126 can be implemented using the Internet. Alternatively, or in addition, the network 126 can be implemented using an intra-company intranet; for instance, the intranet can interconnect a collection of computer devices used by a business, and this intranet can then couple to the Internet via firewall security provisions (not shown). In any case, the network 126 can include any combination of routers, gateways, name servers, hardwired links, wireless links, and so on (although not shown). The individual computer devices (e.g., device 120) can couple to the network via broadband connection, modem coupling, DSL coupling, or other kind of coupling. The coupling of computer devices to the server-based functionality 118 forms a client-server mode of network interchange and processing. However, other models can be used, such as a peer-to-peer (P2P) model.

FIG. 1 illustrates some of the functions that the system 100 can provide by showing different blocks of "logic" within the server-based functionality 118. Server-based pump analysis logic 128 generally performs all of the pump-related analysis tasks to be described below. In operation, an online user can invoke the server-based pump analysis logic 128 via the network 126, and then receive the results of the analysis supplied by the pump analysis logic 128 via the network 126. Sever-based pump analysis logic 128 is the counterpart of the stand-alone pump analysis logic 116 available to the stand-alone device 114.

The server-based functionality 118 can integrate the server-based pump analysis logic 128 with various other functionality to provide a more complete array of services to the online users. For instance, FIG. 1 indicates that the server-based functionality 118 can also include various other analysis tools, identified as "other analysis logic" 130. Commonly assigned U.S. patent applications describe several exemplary analysis tools (e.g., "MyAnalysis" tools), any of which can be provided by the "other analysis logic" 130. These tools can include: benchmarking logic for providing risk quality rating at the facility, division, or enterprise levels; charting logic for charting outstanding risk-improvement recommendations; predictive logic for providing forecasts based on an analysis of historical information; various statistical tools for extracting meaningful information from collected data, and so on. Such tools are described in: (a) U.S. Ser. No. 10/085,497, filed on Feb. 26, 2002, entitled "Risk Management Information Interface System and Associated Methods," (b) U.S. Non-Provisional Ser. No. 10/411,912, filed on Apr. 12, 2003, entitled "Risk Management Information Interface System and Associated Methods," and (c) U.S. Non-Provisional Ser. No. 10/617,315, filed on Jul. 10, 2003, entitled "Methods and Structure for Improved Interactive Statistical Analysis." Each of these applications is incorporated herein by reference in its respective entirety.

In a similar manner, so-called "other reporting logic" 132 can be provided which allows a user to optionally integrate the results of the server-based pump analysis logic 128 into other reporting tools. For example, the other reporting logic 132 can be used to package the results of the server-based pump analysis logic 128 as a part of a more comprehensive report or web-enabled interface portal. Through this comprehensive report or interface, the user can access the results of the server-based pump analysis logic 128 by activating an appropriate part of that report or interface, such as by activating a hypertext link to access the pump analysis results. The pump analysis results can also contain various reference links, which invoke other reports or analysis tools. For instance, upon discovering that a particular fire pump has been graded as poor (based on the pump analysis logic 128), the user may invoke additional information, which yields further insight regarding overall risk-related trends at a particular facility, and so forth. Or a user may investigate industry-wide failure information regarding the pump in question, and so on.

Role-based security logic 134 generally performs the task of granting and denying access to the resources of the server-based functionality 118. This gate-keeping function can be performed by requiring each user to input a user name and a password. The role-based security logic 134 then checks the entered user name and password against a stored list of authorized users; if the username and password match an entry on this list, then access to the server-based functionality 118's resources is permitted.

More specifically, different users of the system 100 may have different roles within the community of individuals who are allowed to interact with the server-based functionality 118. These different roles entitle these users to access and interact with different respective security levels and associated resources maintained by the server-based functionality 118. To provide this role-based selective access, the role-based security logic module 134 can determine a user's access privileges when the user logs into the server-based functionality 118, e.g., by using the user's entered identity information as an index to determine what access privilege information governs the user's interaction with the server-based functionality 118. The role-based security logic module 134 uses this access privilege information to define the types of user interface presentations that the user is permitted to view. The role-based security logic module 134 also uses this access privilege information to define whether the user can retrieve individual resources.

The server-based functionality 118 also includes modification logic 136. This logic 136 allows a user to modify various aspects of the functionality provided by the system 100 (providing that the user is granted authorization by the system 100 to do so). In the context of the present disclosure, the modification logic 136 can enable appropriate authorized individuals to update the equations used to govern the server-based pump analysis logic 128, and so forth.

The logic blocks shown in FIG. 1 are exemplary. The server-based functionality 118 can implement a number of other functions, as generally indicated by the logic block identified as "other logic" 138 in FIG. 1.

The database 124 can store various data. In the context of the present disclosure, the database 124 can include a storage section devoted to storing pump-related data 140. The pump-related data 140 can comprise test data collected during tests conducted at various facilities. Thus, an individual can perform a test, store the test data online, and then perform the analysis on the test data at a later time (or someone else can perform this analysis at a later time). The pump-related data 140 can also include reference data that describes the manner in which the pump is supposed to perform; such reference data can include information that describes the rated characteristics of various pumps, information that describes manufacturers' curves for various pumps, and so forth. The pump-related data 140 can also comprise information that describes the clients on behalf of whom the analysis has been conducted. Still further, the pump-related data 140 can comprise completed reports generated by the server-based fire pump analysis logic 128. The database 124 may also store various other data 142, e.g., which may be useful in the context of other analysis performed by the server-based functionality 118.

The division of processing and informational resources need not adhere to exemplary demarcation shown in FIG. 1, that is, between a completely stand-alone mode and a completely online mode. For instance, in one alternative scenario, a user can interact with the database 124 to download pump-related information, such a manufacturer's curve associated with a fire pump being testing at the facility 102. After receiving the data, the user can then conduct the test and perform the analysis based on the stand-alone pump analysis logic 116 stored as a program within the stand-alone computer device 114. Thereafter, the user can upload the report generated by the analysis for storage in the database 124. Still other scenarios are envisioned.

Henceforth, a general reference to pump analysis logic (116, 128) can refer the stand-alone pump analysis logic 116, the server-based pump analysis logic 128, or some cooperative combination of the stand-alone pump analysis logic 116 and the server-based pump analysis logic 128.

B. Exemplary Device

Figure 2:
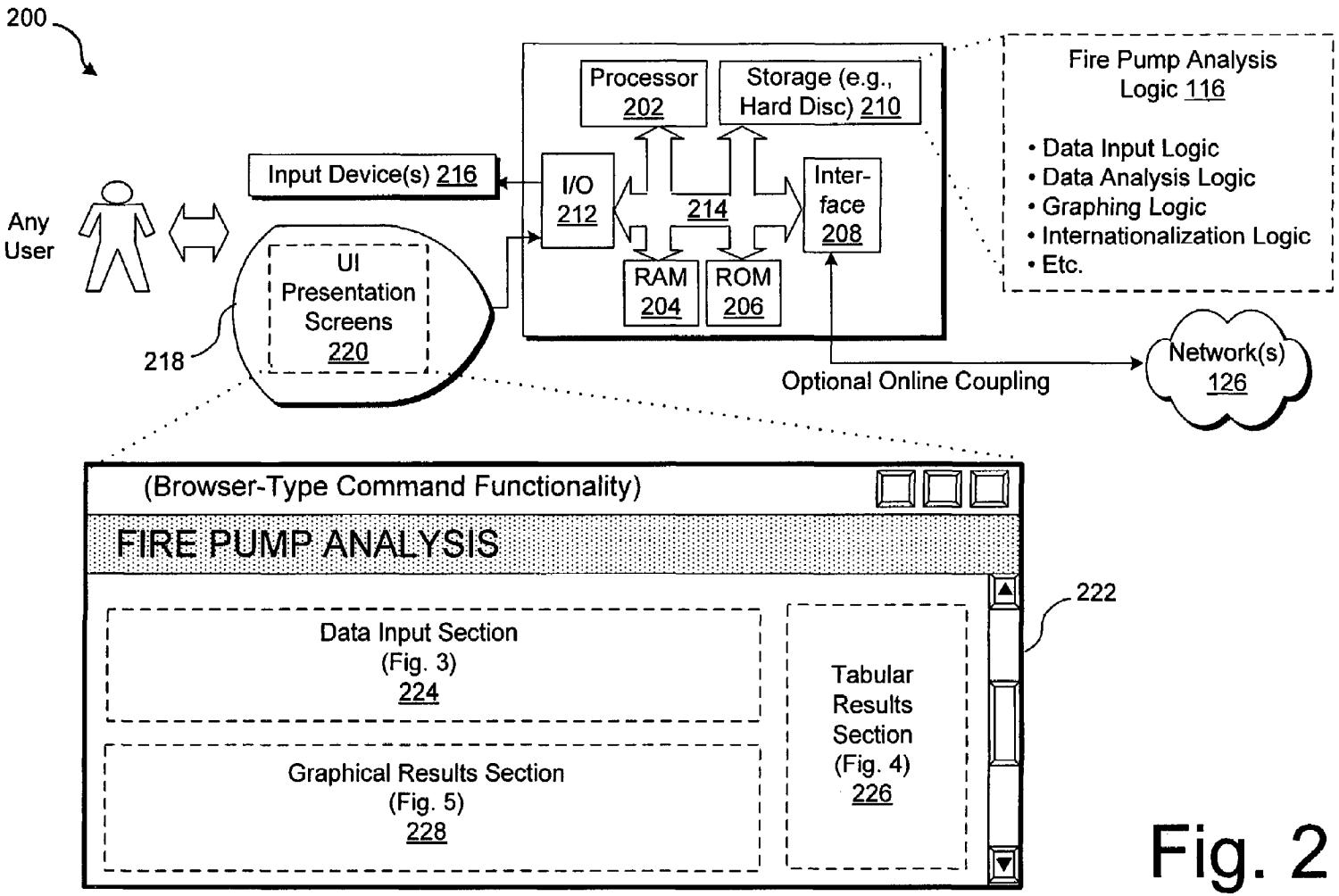
FIG. 2 shows an exemplary electronic device for automatically analyzing the performance of the fire pump, either in a stand-alone fashion or in conjunction with the system of FIG. 1.

FIG. 2 shows the architecture 200 of any one of the devices (e.g., 114, 120) shown in FIG. 1. As noted in Section A, the architecture 200 can correspond to any kind of computer device, such as a personal computer, laptop computer, personal digital assistant (PDA), cell phone, wearable computer, and so forth. The computer architecture 200 can include conventional computer hardware, including a processor 202, RAM 204, ROM 206, a communication interface 208 for interacting with a remote entity (such as another computer device or the server-based functionality 118 via the network 126), storage 210 (e.g., an optical and/or hard disc storage and associated media interface functionality), and an input/output interface 212 for interacting with various input devices and output devices. The above-mentioned components are coupled together using bus 214.

In the stand-alone mode of operation, FIG. 2 shows that the storage 210 can include a program, which provides the pump analysis logic 116. The architecture 200 implements this logic 116 when the machine readable instructions included in this program are stored in RAM 204 and implemented by the processor 202. As will be described in Section C, the pump analysis logic 116 can perform different functions, such as various functions enabling it to input data, to perform computations on the input data to generate output results, to present a graphical depiction of the output results, and so forth. The pump analysis logic 116 can also include functionality, which enables it to be configured to suit different standards appropriate to different jurisdictions (e.g., different foreign countries). For example, the pump analysis logic 116 can be customized to a particular jurisdiction by loading a file for that jurisdiction which supplies parameters and other set-up information appropriate to that jurisdiction.

An input device 216 permits the user to interact with the computer architecture 200 based on information displayed by the computer architecture 200. The input device 220 can include a keyboard, a mouse device, a joy stick, a data glove input mechanism, throttle type input mechanism, track ball input mechanism, a voice recognition input mechanism, a graphical touch-screen display field, and so on, or any combination of these devices.

Finally, an exemplary output device includes the computer display monitor 218, such as a CRT or LCD-based display mechanism. The computer architecture 200 can be configured by pump analysis logic (114, 128) to provide various graphic user interface (GUI) presentations 220 on the computer display monitor 218.

Figure 5:
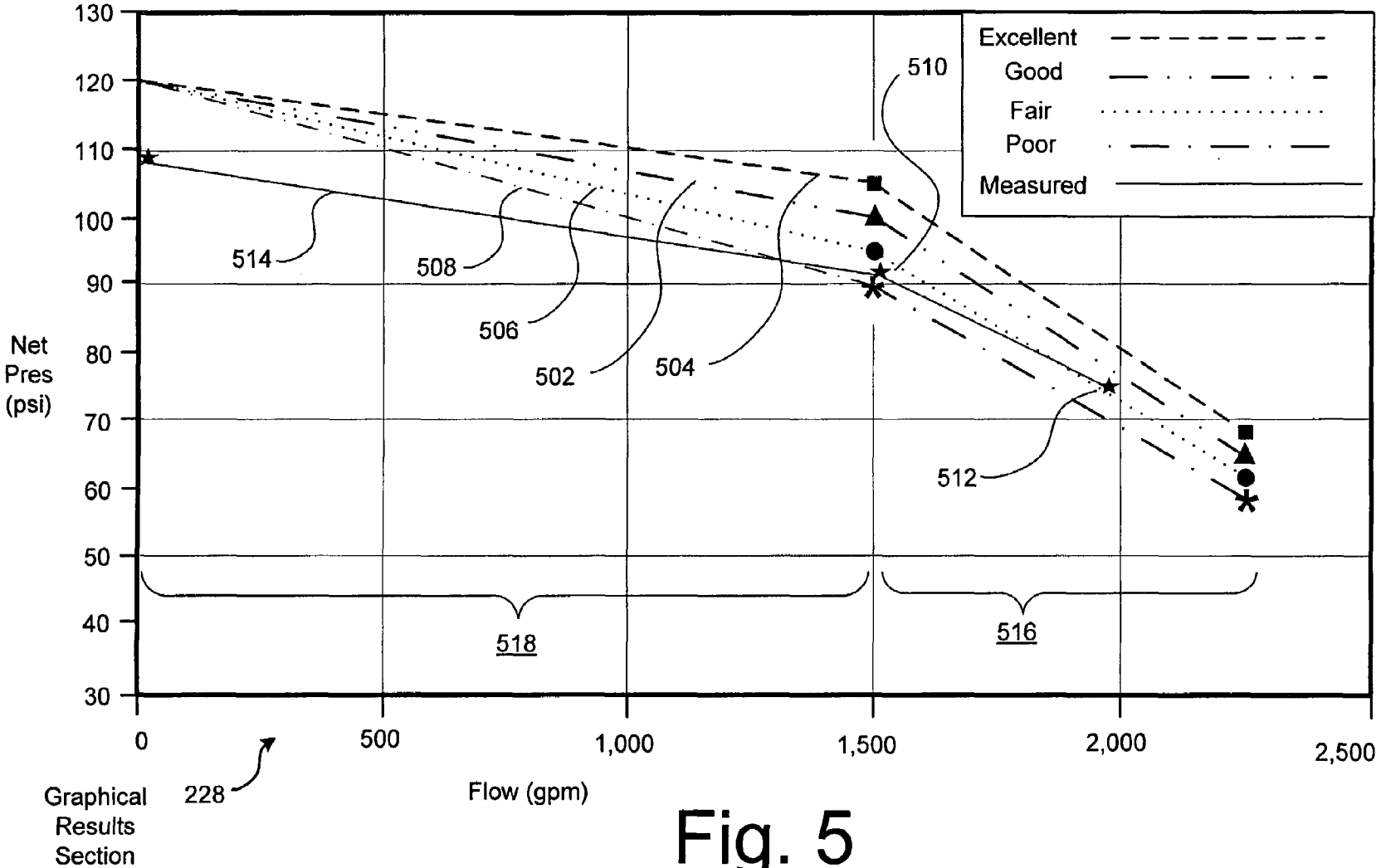

FIG. 2 shows an overview of one exemplary user interface presentation 220 provided by the pump analysis logic (114, 128). Although different configurations are possible (in terms of both content and style), the particular exemplary user interface presentation 220 shown in FIG. 2 includes three sections. A first section 224 is used by a user to supply various test data and reference data to the pump analysis logic 116, 128. This section 224 also automatically populates other data fields included therein based on the input data. FIG. 3 provides an example of the first section 224. A second section 226 provides various output results of the analysis performed by the pump analysis logic (116, 128) in tabular form, that is, by presenting the results in alphanumeric form. FIG. 4 provides an example of the second section 226. A third section 228 provides the output results of the analysis in graphical form, that is, by plotting the performance data vis-à-vis a collection of reference curves corresponding to the excellent, good, fair, and poor performance grades. FIG. 5 provides an example of the third section 226.

C. Exemplary User Interface Presentations

FIGS. 3–5 provide exemplary user interface presentations for use in inputting information into the pump analysis logic (116, 128) and for providing the output results furnished by the pump analysis logic (116, 128). Various different programming models can be used to furnish this functionality, including any computerized data entry table and computation tool. In one exemplary and non-limiting case, spreadsheet functionality is used to provide a single integrated display presentation for inputting data and for providing output results. Among other programs, the EXCEL software program provided by Microsoft Corporation of Redmond, Wash. can be used to provide the spreadsheet functionality. In a spreadsheet program, such as EXCEL, formulas can be embedded into individual cells of the report, which provide a mechanism for computing the contents of those cells based on the contents contained in other cells that are referenced by the formulas.

The user interface presentations shown in these figures are exemplary and non-limiting. Other types of user interface presentations can be provided which implement the principles described herein. These other presentations may vary from the sections (224, 226, 228) shown in FIGS. 3–5 in both style and content.

Beginning with FIG. 3, this figure shows the data input section 224 for receiving various test and reference data, and for populating various other cells in the section 224 with performance data derived from this input data. Each of the fields in this section 224 will be described below in turn. To begin with, a few general comments are provided by way of overview. The top portion of the section 224 is generally used to receive various reference data, e.g., describing the client who owns or operates the pump, and defining the characteristics of the pump itself (e.g., its rated performance characteristics). The bottom left-half rows of the section 224 generally provide various test data collected during the performance of the test. The bottom right-half rows of the section 224 generally provide various performance data that is automatically populated based on both the supplied reference data and the test data. For convenience, the various fields in the spreadsheet will be referenced by identifying the cells which contain the labels for those fields; however, the reader will appreciate that the cells which actually receive values for the identified fields are located adjacent to the cells containing the labels (to the right of the cells containing the labels or below the cells containing the labels).

Starting from the top left of the section 224 and generally advancing to the right as the discussion proceeds, an account field 302 defines an input field for entering alpha-numeric information that identifies the company that owns or operates the fire pump being tested (e.g., in this case, the fictitious ABC Industries, Inc.). A location field 304 identifies the location of the facility, which houses the fire pump (e.g., in this case, Syracuse, N.Y.). A location ID field 306 provides a code that represents both the account and the location; for instance, in one exemplary and non-limiting case, a six-digit code is assigned to the account and another six-digit code is assigned to the location, and these two codes are combined to provide the complete code for field 306. A consultant field 308 allows the user to input the name (or other information) which identifies the person who performed the test, and/or who conducted the analysis, and/or who served some other role in connection with the analysis.

Advancing to the top of the next column, a pump ID field 310 provides any kind of information used to identify the pump being tested. In this particular case, the user has used this field 310 to indicate that the pump being tested is a diesel pump. This field 310 might also be devoted to providing facility-specific names associated with the pump for shorthand reference (e.g., "pump1," "pump2," etc.). Model field 312 and serial number field 314 provide other input fields through which the user can identify the pump being tested.

A date field 316 identifies the date when the test was conducted. A notes field 318 allows the user to input any notes pertinent to the test for future reference. For instance, as will be described below, in the test scenario used to populate the fields in FIGS. 3–5, the pump could not operate at 150 percent of its rated flow for some reason (corresponding to the third operational state of the standard curve). The user has noted this fact in the notes field 318.

A next series of fields define the rated performance characteristics of the pump. Loosely stated, the rated characteristics define the operational state at which the pump should be operated, although the pump is also designed to operate at flows and pressures in excess of its rated performance characteristics. Namely, rated flow field 320 identifies the rated flow of the pump (in this case it is 1,500 gallons per minute). A rated pressure field 322 identifies the rated pressure of the pump (in this case it is 100 psi). A rated speed field 324 identifies the rated speed of the pump (in this case it is 1760 rpm).

And finally, a rated psi at 150% flow field 326 identifies a minimum percent of rated pressure that should be achieved when the pump is being operated at 150 percent of its rated flow. This field 326 can assume two types of values. This field currently has the value of 65 percent of the rated pressure value in 322, which correspond to the default case where a standard curve is being used as the reference data. However, in an alternative scenario, a manufacturer's curve may be available which may provide another pressure value for the 150 percent flow reading, such as, say, 70 psi. The user remains free to input this number into field 326. The rated values in fields 320, 322 and 326 are generally important because these values define the characteristics of the reference curves that are used to grade the actual performance data (as will be described in greater detail below). It is preferable to use a manufacturer-specific value in field 326 because it will provide a more accurate baseline against which the performance data can be compared. As a default, however, the pump analysis logic (116, 128) will populate field 326 with the standard curve pressure value of 65% of the rated pressure. To the far upper right, a suction size field 328 defines the pipe diameter size of the intake side of the pump. A discharge size field 330 defines the pump outlet pipe diameter size of the pump. A differential in these values will result in a non-zero head-correction value (to be described below).

Now advancing to the lower portion of section 224, the bottom three rows (332, 334, and 336) define different values associated with the three operational states of the pump, namely: (a) a churn state at zero flow and some percentage of rated pressure; (b) a normal state at about 100 percent of rated flow; and (c) an over-capacity state at about 150 percent of the rated flow (or some other excess capacity). For example, values in exemplary row 334 pertain to test data and computed performance data associated with the pump when it is operated at 100 percent of the rated flow, which optimally should achieve at least 100 percent of the rated pressure.

The first of the fields in this section is the flowing outlet ID field 338. This section defines the inside diameter size of the output nozzles attached to the fire hose used to perform the test. In the present case, this field 338 is populated with values specifying 1.75" for each of the three operational states. The Cd field 340 defines the coefficient of discharge associated with the type of nozzle used to discharge the water. For one exemplary and non-limiting case, the Cd value is defined as 0.97, since an "underwriters" play pipe was used during the test.

There are two ways flow measurements can be taken. In a first technique, pitot readings field 342 receives test data collected using the pitot tube instrument for the three operational states. As previously described, the pitot tube instrument can be used to determine flow by taking various pressure readings. Namely, the pitot tube is placed into the water stream against the nozzle to obtain the flowing pressure readings, which are later hydraulically converted to gallons per minute (gpm). The pitot readings field 342 generally allows the user to take plural readings, e.g., in this specific case, up to ten measurements for each operational state. In a second technique, flow meter field 344 receives flow meter readings available from a meter integrated with the pump itself (if available). A user might wish to perform flow meter readings, for instance, when it is not possible to conduct flow tests by taking pitot readings (e.g., because of weather conditions, and so forth).

A combined flow field 346 provides combined flow values that are computed based on the input test data. For example, consider the case of the combined flow value for row 334. It is defined using the following equation:

$$\begin{aligned}\text{Combined Flow} = {} & 29.83 * Cd * FlowOutlet^2 * FirstPitotMeasure^{0.5} + \\ & 29.83 * Cd * FlowOutlet^2 * SecondPitotMeasure^{0.5} + \\ & 29.83 * Cd * FlowOutlet^2 * ThirdPitotMeasure^{0.5} \ldots + \\ & 29.83 * Cd * FlowOutlet^2 * LastPitotMeasure^{0.5} + FlowMeter\end{aligned}$$

where the term Cd defines the value of the field 340 in the second row 334, the term FlowOutlet defines the value of the field 338 in the second row 334, and terms FirstPitotMeasure, SecondPitotMeasure . . . LastPitotMeasure, define the successive values of field 342 in the second row 334. The term FlowMeter defines the value of the field 344 for the second row 334. If pitot readings are taken, rather than flow meter readings, then the value of the flow meter reading will be 0, and vice versa.

The next series of fields pertain to pressure. Namely, a suction pressure field 348 receives test data describing suction pressure (in psi) and a discharge pressure field 350 receives test data describing discharge pressure (in psi). The suction pressure defines an incoming pressure associated with the fluid intake of the fire pump, and the discharge pressure defines an outgoing pressure associated with the outlet side of the fire pump. The function of the fire pump is to take an incoming suction pressure and boost it to a prescribed pressure. For example, a pump rated at 100 psi operating at rated conditions with a suction pressure of 10 psi should provide a discharge pressure of 110 psi.

The next field, head correction 352, provides a velocity head pressure correction. This correction pressure accounts for any disparity in pipe sizes defined in fields 328 and 330 (suction size and discharge size). In the present case, there is no difference, so the correction pressure value is identified as zero. In one exemplary and non-limiting case, if there is a difference, then the correction pressure for a particular operational state (associated with a particular row) is computed as:

$$CorrectionPress=0.001123*CombinedFlow^2*[(1/DischargeSize^4)-(1/SuctionSize^4)]$$

where CorrectionPress defines the correction pressure, CombinedFlow defines the value in field 346, DischargeSize defines the value in the field 330, and SuctionSize defines the value in the field 328.

The above-described pressure fields (348, 350, 352) are used to compute a net pressure field 354. Namely, the net pressure field 354 is determined by subtracting the suction pressure in field 348 from the discharge pressure in field 350, and then adding the correction pressure in field 352 (for each of the operational states corresponding to the three separate rows).

The pump speed field 356 identifies the speed of the pump in revolutions per minute (rpm). Pump speed should be recorded as a rule. In some pumps, the speed of the driving motor is also the speed of the pump itself (because there is a one-to-one relationship between the driving mechanism and its coupling to the pump). For some turbine diesel-powered fire pumps, this may not be the case.

The final set of fields (358, 360) provides speed-corrected values for flow and pressure values previously computed. Namely, a corrected flow field 358 provides a speed-corrected flow, and a corrected pressure field 360 provides a speed-corrected pressure. More formally, for each row, the corrected flow field 358 can be computed as:

$$CorrectedFlow=CombinedFlow*(RatedSpeed/ActualPumpSpeed)$$

where the CorrectedFlow term defines the value in the corrected flow field 358, the CombinedFlow term defines the value in the field 346, the RatedSpeed term defines the value in the field 324, and the ActualPumpSpeed value defines the value in the field 356.

The corrected pressure field 360 can be computed, for each row, as:

$$CorrectedPressure=NetPressure*(RatedSpeed/ActualPumpSpeed)^2$$

where the CorrectedPressure term defines the value in the corrected pressure field 360, the NetPressure term defines the value in the field 354, the RatedSpeed term defines the value in the field 324, and the ActualPumpSpeed defines the value in the field 356.

The preceding two fields (the corrected flow in field 358 and the corrected pressure in field 360) provide the computed "actual performance data" that is used to define how the pump actually performed during the test. These values also serve as the basis for comparing the performance of the pump to the reference data, which is computed from the rating information provided in the top part of the section 224. The specific manner in which these comparisons are performed will be fully explained below in connection with FIGS. 4 and 5. At this juncture in the description, suffice it to say that data point rating field 362 provides a grading result that reflects the outcome of the comparison for each of the data points associated with the three respective operational states of the pump. The grades are selected from the exemplary and non-limiting categories of excellent, good, fair, and poor. Overall rating field 364 then computes a final grade for the pump as a whole. In one case, the analysis logic (116, 128) takes the lowest grade assigned to an individual data point and uses that grade as the overall grade (using the philosophy that the weakest link in the performance defines how good the pump is performing overall).

Advancing now to FIG. 4, this figure shows the tabular results section 226. The purpose of this section 226 is to identify the performance of the pump (vis-à-vis the reference data) in tabular form using alpha-numeric information (e.g., as opposed to graphical representation).

A first part 402 of this section 226 defines the characteristics of the reference curves against which the actual performance data (in fields 358 and 360) will be compared. By way of overview, a "good" reference curve will track either the standard curve or the manufacturer's curve, depending on whatever one is specified in field 326. For example, the first part 402 includes a section associated with the good curve; the reader will note that the values in that section track the standard curve exactly (because a standard curve is being used, as per the value input into field 326).

The other reference curves will represent prescribed deviations from the good curve. For instance, an excellent curve is offset above the good curve by five percent. On the other hand, a fair reference curve is offset below the good curve by five percent. A poor reference curve is offset below the good curve by 10 percent. These pressure offsets result in the appropriately scaled pressure readings shown in the last column of the first part 402. Note that the values in the last column of part 402 will change depending on the rated pressure value, which is input to field 326.

In general, the reference curves establish ranges, which define the grading of the pump. If the actual performance data for a data point is above the excellent curve (e.g., greater than 105 percent of the expected value), then the pump is graded as excellent for that data point. If the actual performance data for a data point is anywhere between the excellent curve and the fair curve (e.g., between 105 percent and 95 percent of the expected value), then the pump is graded as good for that data point. If the actual performance data for a data point is anywhere between the fair curve and the poor curve (e.g., between 95 percent and 90 percent of the expected value), then the pump is graded as fair for that data point. Finally, if the actual performance data for a data point is below the poor curve (e.g., below 90 percent of the expected value), then the pump is graded as poor for that data point. The second part 404 of section 226 provides a key, which explains this classification scheme. (It should be noted that this classification scheme is exemplary and non-limiting). Other classification schemes can be used which provide a different number of gradations, and/or different intervals between gradations, and/or different labels associated with the gradations, and so forth. For example, in another variation, the gradations can be 1 percent, 2 percent . . . 10 percent, and so on (although even smaller and even larger deviations are permitted too).

The final part of section 226 provides the precise computations that are used to determine where the actual performance data lies with respect to the reference scheme identified above. The three rows in this part 406 again correspond to the three operational states at which the pump has been tested; accordingly, the data that is used to populate the part 406 is pulled from corresponding rows (332, 334, 336) of section 224.

To begin with, a "% Rated gpm" field 408 provides a fractional value determined by dividing the corrected flow value in field 358 by the rated flow value in field 320.

Figure 6:
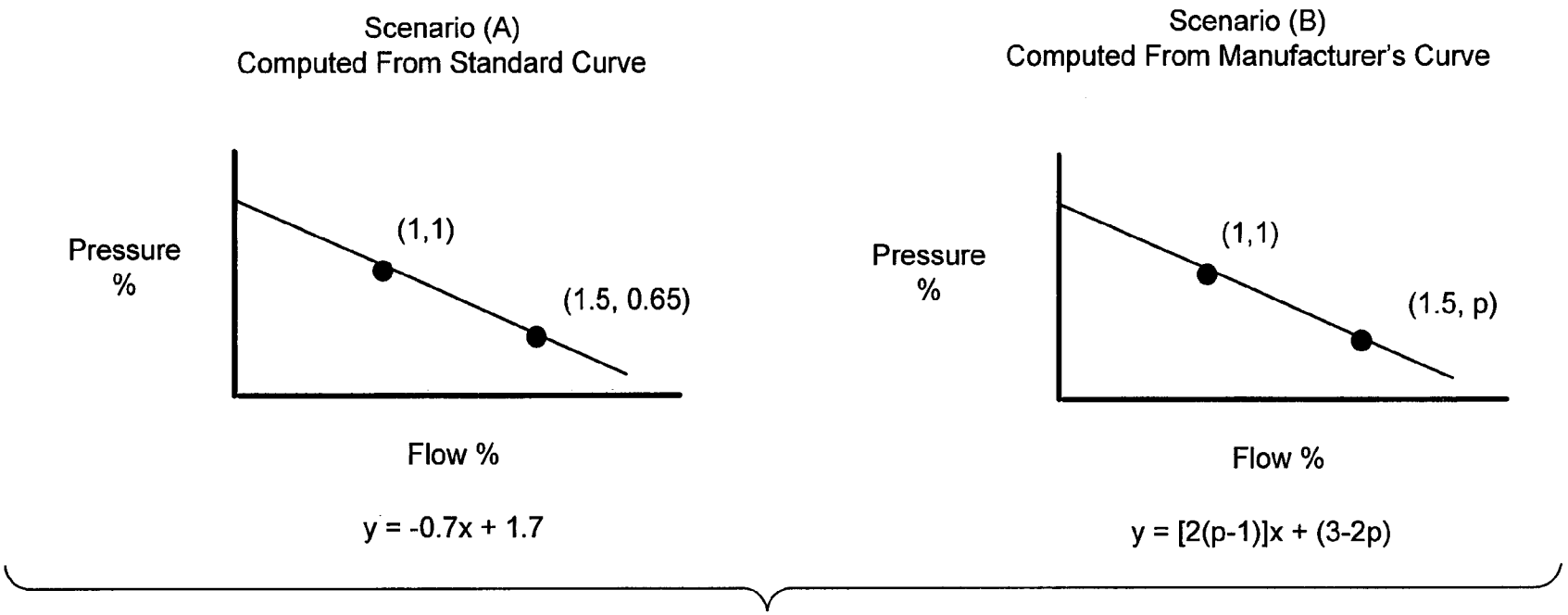
FIG. 6 provides exemplary information regarding the derivation of equations used in the user interface presentations of FIGS. 3–5.

An "Est % Rated psi" field 410 yields fractional pressure data. FIG. 6 provides information regarding how this field 410 is computed. These figures show two curves that correspond to different reference data scenarios. Scenario A corresponds to the case where the standard curve is being used to supply the reference data, whereas scenario B corresponds to the case where the manufacturer's curve is being used to supply the reference data. Thus, to compute field 410, a first equation developed for the case of scenario A is used when the standard curve is being employed. A second equation developed for the case of scenario B is used if the manufacturer's curve is being employed. In the example developed in FIGS. 3–5, the standard curve is being employed.

Consider the case of scenario A. The downward sloping line shown there maps fractional flow values into fractional pressure values. The general goal in computing field 410 is to use the fractional flow value in field 408 as an input variable to determine the fractional pressure value in field 410. In scenario A, the curve is defined by two data points (1, 1) and (1.5, 0.65), corresponding respectively to: (1) the operation of the pump at 100 percent of the rated flow and at 100 percent of the rated pressure, and (2) the operation of the pump at 150 percent of the rated flow and at 65 percent of the rated pressure. The equation defining this curve is $y=0.7x+1.7$. Accordingly, this equation yields the value for field 410 by substituting the value from field 408 in place of the x variable. More intuitively stated, the value in field 410 corresponds to the fractional pressure data that the pump should have yielded if it was operating up to the standards defined by the standard curve.

As to scenario B, the manufacturer's curve is defined by data points (1, 1) and (1.5, p), which is the same as the standard curve model of scenario A except for the fact that the pressure information is left open-ended using the variable p. To repeat, the value p is supplied by the value input to field 326 in section 224. The equation defining this curve is $y=[2(p-1)]x+(3-2p)$. This equation yields best results in the range of about 95 percent to about 150 percent. In general, the pump analysis can include provisions which restrict its equations to prescribed data ranges to which the equations best apply.

The field "Est psi" 412 takes the value in the preceding field 410 and multiplies it by the rated pressure in field 322. Effectively, this converts the fractional values in field 410 to yield expected performance data that reflects the performance that the pump should have optimally produced during the test for the flow conditions set forth in field 408.

The next field 414 ("% of psi") makes an assessment of how the actual performance data diverges from the expected performance data. More formally, this field 414 is computed by subtracting the expected performance data identified in field 412 from the actual (speed-corrected) performance data identified in field 360. This difference is then converted to fractional form by dividing this difference by the value in field 412. Stated more intuitively, the fractional values in field 414 reflect, in terms of percentage, the extent to which the actual performance of the pump diverged from the expected performance of the pump (ultimately measured by the rated characteristics of the pump, in conjunction with either the standard curve of the manufacturer's curve).

The next two fields (416, 418) assign grades to the fraction values in field 414. Namely, if the fractional value is less than −0.1 (i.e., 10 percent) then the grade is poor for a particular data point. If the fractional value is between −0.05 and −1.0, then the grade is fair for a particular data point. If the fractional value is between −0.05 and +0.05, then the grade is good for a particular data point. If the fractional value is over +0.05, then the grade is excellent for a particular data point. The overall rating in field 418 is essential the lowest grade that appears in the preceding field 416.

In one case, section 226 can be furnished to any user who interacts with the pump analysis logic (116, 128). In another case, the pump analysis logic (116, 128) can provide section 226 only for those users who are authorized to actually input the test data and perform analysis. In this case, the pump analysis logic (116, 128) can omit section 226 for those users who simply are interested in how the pump performed, e.g., and are not necessarily interested in the mathematics, which underlies the computation of the overall grade.

FIG. 5 shows the last section 228 of the user interface presentation. This section 228 presents the results discussed in connection with section 226 in graphical format.

Namely, the various dashed lines in section 228 reflect reference curves that are plotted based on the reference data points provided in part 402 of section 226. Good curve 502 defines the baseline for comparison; its shape is determined by the data points in either the standard curve or the manufacturer's curve. An excellent curve 504 represents a 5 percent deviation above the good curve 502. A fair curve 506 represents a 5 percent deviation below the good curve 502. And a poor curve 508 defines a 10 percent deviation below the good curve 502. The regions between these curves therefore define ranges used to classify actual performance data as one of: excellent, good, fair or poor. A data point above the excellent curve 504 is graded as excellent. A data point between the excellent curve 504 and the fair curve 506 is graded as good. A data point between the fair curve 506 and the poor curve 508 is graded as fair. A data point below the poor curve 508 is graded as poor.

For example, FIG. 5 shows a first data point 510 that corresponds to the operational state in which the pump was tested at around 100 percent of its rated flow. This data point 510 corresponds to the corrected values provided in fields 358 and 360 of FIG. 3, row 334. Note that the data point 510 lies between the fair curve 506 and the poor curve 508, and is therefore graded as fair. A second data point 512 corresponds to the operational state where the pump was tested at excess capacity. The tester may have attempted to achieve a desired flow of 150 percent of the rated flow (2500 gpm), but only achieved a rated flow of 1,968 gpm due to some problem with the pump, test conditions or test procedures. In any event, this data point 512 lies between the excellent curve 504 and the fair curve 506, and is therefore graded as good. The overall grade is fair, because the pump is graded pursuant to its weakest performance (e.g., its lowest performance). A solid black curve 514 defines a line that connected the above-identified data points (510, 512).

Note that the performance of the pump is assessed in region 516 of the graph. This region 516 corresponds to the last two operational states of the three-part measurement regimen. A first region 518 (from the churn state to the full rated flow and pressure state) might reveal useful information in some circumstances. However, a number of factors in the pump's performance might make this region 518 unreliable as a diagnostic tool, such as the inclusion of relief valves, which may operate in this region 518.

D. Exemplary Procedures

The remaining figures summarize the above-described concepts in flowchart form.

Figure 7:
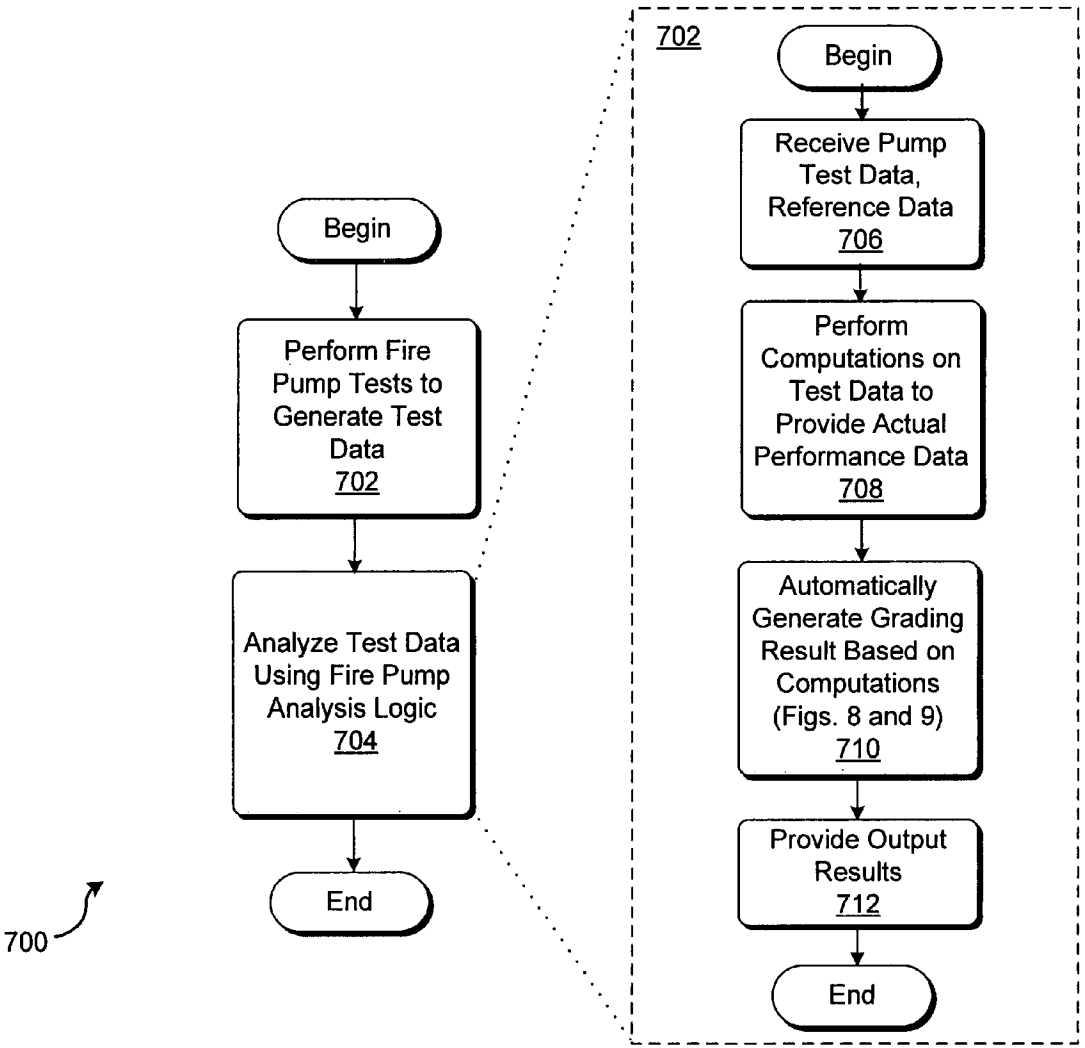
FIGS. 7–9 show exemplary procedures for analyzing the fire pumps using the functionality set forth in FIGS. 1–6.

To begin with, FIG. 7 shows an overview of a testing and analysis procedure 700 that makes use of the pump analysis logic (116, 128) described above. Step 702 of that procedure 700 involves conducting the tests in the manner described above. This generates test data. Step 704 entails using the pump analysis logic (116, 128) to grade the pump based on the test data in conjunction with reference data.

The right-hand portion of FIG. 7 expands the steps involved in the basic step 704. Step 706 of the analysis comprises receiving the pump test data. This can comprise entering the pitot data in field 342 of the FIG. 3 (or the flow meter data in field 344), and various other test data that was previously discussed. Step 706 can also entail inputting various reference data, such as the rated flow, pressure, speed and so forth.

Step 708 entails performing various computations on the input data to provide what is called "actual performance data" (in the terminology used herein). In the context of FIG. 3, the final actual performance data is reflected in the speed-corrected flow data and pressure data provided in fields 358 and 360, respectively.

Figure 8:
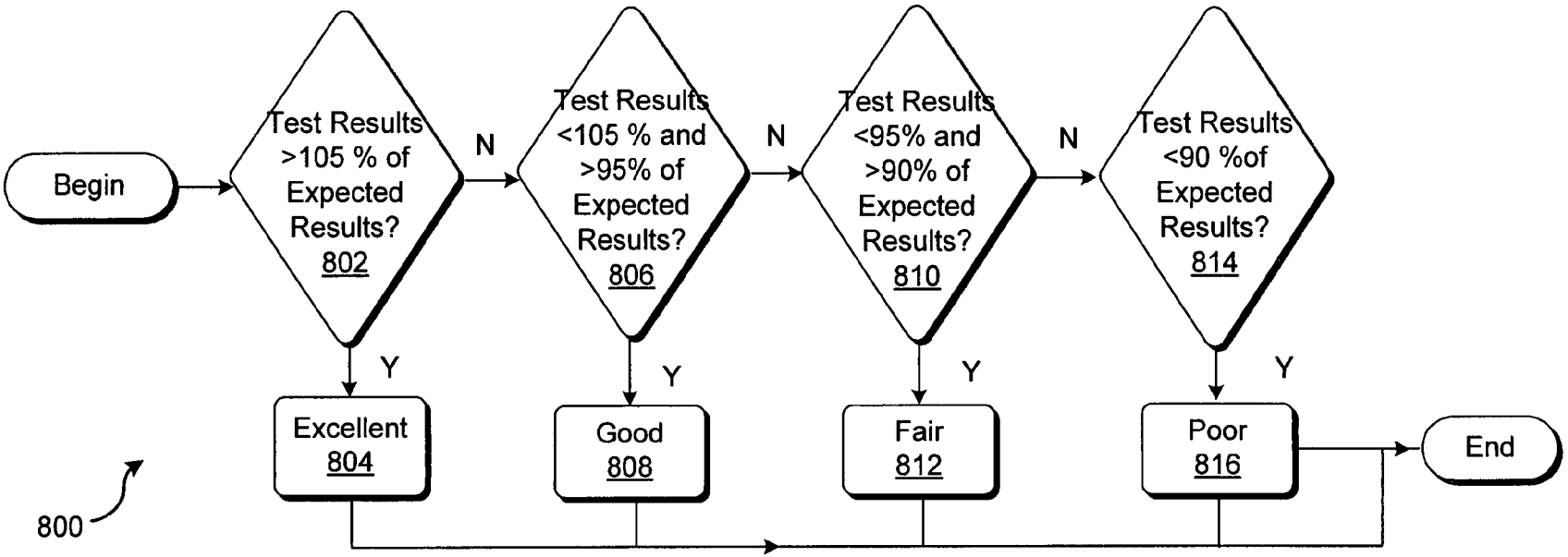
Figure 9:
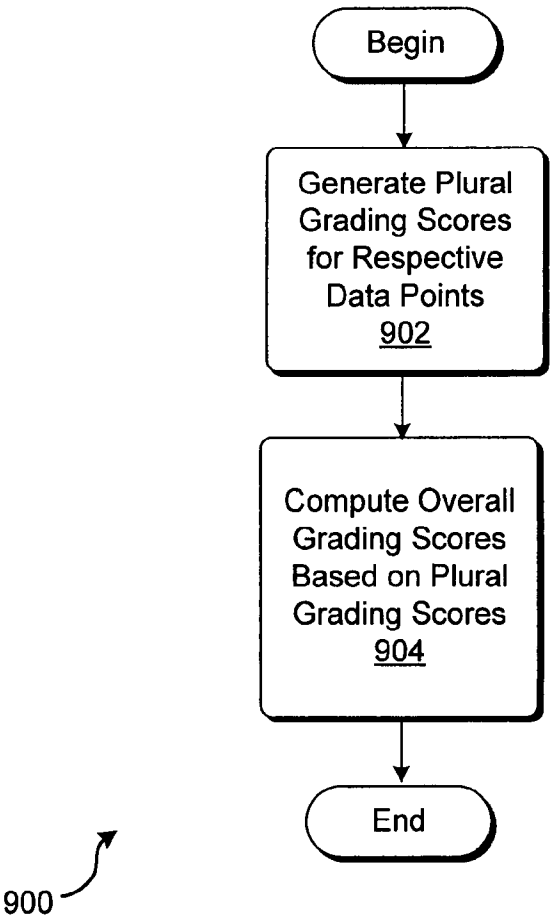

Step 710 entails automatically grading the pump based on a comparison of the actual performance data and the reference data. More specifically, grades can be assigned to individual data points based on a comparison of the actual performance data with expected performance data (which is based on the reference performance data) in the manner described above. An overall grade can then be formed based on an evaluation of each of the individual grades. FIGS. 8 and 9 provide additional information regarding these computations in flowchart form.

Finally, step 712 entails providing the output results, which convey the grading. One way of conveying the grading is via alpha-numeric information, as shown in FIGS. 3 and 4. Another way of conveying the grading is via graphical presentation, as shown in FIG. 5.

FIGS. 8 and 9 illustrate the grading operation in flowchart form. Namely, FIG. 8 shows a procedure 800, which explains the grading of an individual data point (e.g., corresponding to one of the three operational states of the flow test). Step 802 determines whether the actual performance data is above 105 percent of the expected results; if so, step 804 assigns a grade of excellent to the data point. Step 806 determines whether the actual performance data is between 105 percent and 95 percent of the expected results; if so, step 808 assigns a grade of good to the data point. Step 810 determines whether the performance data is between 95 percent and 90 percent of the expected results; if so, step 812 assigns a grade of fair to the data point. And finally, step 814 determines whether the performance data is under 90 percent of the expected value; if so, step 816 assigns a grade of poor to the data point.

FIG. 9 shows a procedure 900, which explains the analysis of plural grades, assigned to plural respective data points to arrive at an overall grade. Step 902 entails generating the plural grades in the manner already described in connection with FIG. 8. Step 904 entails computing an overall grade based on a consideration of the plural grades. This can involve selecting the overall grade to be the lowest grade of any graded data point.

A number of examples were presented in this disclosure in the alternative (e.g., case X or case Y). In addition, this disclosure encompasses those cases, which combine alternatives in a single implementation (e.g., case X and case Y), even though this disclosure may have not expressly mentioned these conjunctive cases in every instance.

Moreover, a number of features were described herein by first identifying exemplary problems that these features can address. This manner of explication does not constitute an admission that others have appreciated and/or articulated the problems in the manner specified herein. Appreciation and articulation of the problems present in the fire pump testing art is to be understood as part of the present invention.

More generally, although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

What is claimed is:

1. A method for analyzing the performance of a pump, comprising:

receiving test data that reflects a test performance of the pump during a test;

receiving reference data that reflects a reference performance of the pump;

performing computations on the test data to generate actual performance data;

comparing the actual performance data against the reference data to provide at least one comparison result;

automatically assigning a grade to the pump based on said at least one comparison result; and presenting information regarding the assigned grade to a user, wherein the comparing comprises:

computing plural ranges that describe plural respective deviations from the reference data; and determining said at least one comparison result by determining which of the plural ranges that the actual performance data lies within, wherein the plural ranges each represents a prescribed percent deviation from the reference data.

2. The method of claim 1, wherein the pump is a fire pump.

3. The method of claim 1, wherein the receiving of test data and reference data, performing, comparing, assigning, and presenting are performed by a stand-alone electronic device.

4. The method of claim 1, wherein the receiving of test data and reference data, performing, comparing, assigning, and presenting are performed by an electronic device in cooperation with server-based functionality.

5. The method of claim 1, wherein the test data represents the measured performance of the pump: (a) at zero flow; (b) at about 100 percent of the pump's rated flow; and (c) at some percent of the pump's rated flow between about 100 percent and about 150 percent.

6. The method of claim 1, wherein the test data pertains to data collected during the test of the pump by pitot tube test functionality.

7. The method of claim 1, wherein the test data pertains to data collected during the test of the pump by a flow meter associated with the pump.

8. The method of claim 1, wherein the reference data describes a standard curve for use as a default if a manufacturer's curve is not available.

9. The method of claim 1, wherein the reference data describes a manufacturer's curve associated with the pump.

10. The method of claim 1, wherein the performing of computations comprises transforming the test data into the actual performance data by computing combined flow data, and then correcting the combined flow data for actual pump speed.

11. The method of claim 1, wherein the comparing comprises:

providing an equation that describes a reference curve associated with the reference data;

using the reference curve to determine expected performance data that describes how the pump should have performed when tested; and determining said at least one comparison result by comparing the expected performance data with the actual performance data.

12. The method of claim 11, wherein the equation is based on a standard reference curve.

13. The method of claim 11, wherein the equation is based on a manufacturer's reference curve.

14. The method of claim 1, wherein the plural ranges vary in increments, wherein the increments can be set at approximately 1 percent to approximately 10 percent.

15. The method of claim 1, wherein the presenting comprising providing an alpha-numeric indication of the grade.

16. One or more computer readable media including machine-readable instructions for implementing the method of claim 1.

17. A module including logic configured to implement the method of claim 1.

18. A method for analyzing the performance of a pump, comprising:

receiving test data that reflects a test performance of the pump during a test;

receiving reference data that reflects a reference performance of the pump;

performing computations on the test data to generate actual performance data;

comparing the actual performance data against the reference data to provide at least one comparison result;

automatically assigning a grade to the pump based on said at least one comparison result; and presenting information regarding the assigned grade to a user, wherein the performing of computations comprises transforming the test data into the actual performance data by computing net pressure data, and then correcting the combined flow data for actual pump speed.

19. One or more computer readable media including machine-readable instructions for implementing the method of claim 18.

20. A module including logic configured to implement the method of claim 18.

21. A method for analyzing the performance of a pump, comprising:

receiving test data that reflects a test performance of the pump during a test;

receiving reference data that reflects a reference performance of the pump;

performing computations on the test data to generate actual performance data;

comparing the actual performance data against the reference data to provide at least one comparison result;

automatically assigning a grade to the pump based on said at least one comparison result; and presenting information regarding the assigned grade to a user, wherein the comparing comprises:

computing plural ranges that describe plural respective deviations from the reference data; and determining said at least one comparison result by determining which of the plural ranges that the actual performance data lies within, wherein the plural ranges have respective grades associated therewith, and the assigning comprises, based on said at least one comparison result, assigning a grade associated with the range that the actual performance data lies within, and wherein the plural ranges have at least four is respective grades associated therewith having different respective labels assigned thereto.

22. One or more computer readable media including machine-readable instructions for implementing the method of claim 21.

23. A module including logic configured to implement the method of claim 21.

24. A method for analyzing the performance of a pump, comprising:

receiving test data that reflects a test performance of the pump during a test;

receiving reference data that reflects a reference performance of the pump;

performing computations on the test data to generate actual performance data;

comparing the actual performance data against the reference data to provide at least one comparison result;

automatically assigning a grade to the pump based on said at least one comparison result; and presenting information regarding the assigned grade to a user, wherein the comparing comprises:

computing plural ranges that describe plural respective deviations from the reference data; and determining said at least one comparison result by determining which of the plural ranges that the actual performance data lies within, and wherein the actual performance data reflects plural different operational states involved in the test, and wherein:

the determining comprises computing plural different comparison results associated with the plural respective operational states; and the assigning comprises, based on the plural comparison results, assigning plural grades associated with the plural respective operation states.

25. The method of claim 24, wherein the assigning comprises determining an overall grade associated with the pump based on the plural grades associated with the plural respective operational states.

26. The method of claim 25, wherein the assigning comprises selecting the lowest grade among the plural grades as the overall grade.

27. One or more computer readable media including machine-readable instructions for implementing the method of claim 24.

28. A module including logic configured to implement the method of claim 24.

29. A method for analyzing the performance of a pump, comprising:

receiving test data that reflects a test performance of the pump during a test;

receiving reference data that reflects a reference performance of the pump;

performing computations on the test data to generate actual performance data;

comparing the actual performance data against the reference data to provide at least one comparison result;

automatically assigning a grade to the pump based on said at least one comparison result; and presenting information regarding the assigned grade to a user, wherein the presenting comprises presenting a graphical representation of the actual performance data relative to the reference data, and wherein the presenting comprises presenting plural reference curves which represent plural respective deviations from the reference data, wherein the grade of the pump can be assessed by determining the graphical position of the actual performance data relative to the plural reference curves.

30. One or more computer readable media including machine-readable instructions for implementing the method of claim 29.

31. A module including logic configured to implement the method of claim 29.

32. A module for analyzing the performance of a pump, comprising:

logic configured to receive test data that reflects a test performance of the pump during a test;

logic configured to receive reference data that reflects a reference performance of the pump;

logic configured to perform computations on the test data to generate actual performance data;

logic configured to compare the actual performance data against the reference data to provide at least one comparison result; and logic configured to automatically assign a grade to the pump based on said at least one comparison result.

wherein the logic configured to compare comprises:

logic configured to compute plural ranges that describe plural respective deviations from the reference data; and logic configured to determine said at least one comparison result by determining which of the plural ranges that the actual performance data lies within, wherein the plural ranges each represents a prescribed percent deviation from the reference data.

33. The module of claim 32, wherein the module is implemented in a stand-alone electronic device.

34. The module of claim 32, wherein the module is implemented as logic functionality within a server that is accessible to an electronic device via a coupling mechanism.

35. A module for analyzing the performance of a pump, comprising:

means for receiving test data that reflects a test performance of the pump during a test;

means for receiving reference data that reflects a reference performance of the pump;

means for performing computations on the test data to generate actual performance data;

means for comparing the actual performance data against the reference data to provide at least one comparison result; and means for automatically assigning a grade to the pump based on said at least one comparison result, wherein the means for comparing comprises:

means for computing plural ranges that describe plural respective deviations from the reference data; and means for determining said at least one comparison result by determining which of the plural ranges that the actual performance data lies within, wherein the plural ranges each represents a prescribed percent deviation from the reference data.

36. One or more computer readable media including machine-readable instructions for implementing each of the means of claim 35.

37. A method for analyzing the performance of a pump, comprising:

inputting test data that reflects a test performance of the pump during a test;

receiving reference data that reflects a reference performance of the pump;

performing computations on the test data to generate actual performance data;

automatically assigning a grade to the pump based on a comparison of the actual performance data and the reference data; and presenting information regarding the assigned grade to a user in a graphical presentation, wherein the presenting comprises presenting plural reference curves which represent plural respective deviations from the reference data, wherein the grade of the pump can be assessed by determining the graphical position of the actual performance data relative to the plural reference curves.

38. The method of claim 37, wherein the plural reference curves respectively correspond to at least four different grades having different respective labels assigned thereto.

39. The method of claim 37, further comprising providing explicit information that identifies the grade assigned to the pump.

40. The method of claim 39, wherein the explicit information comprises alpha-numeric information that identifies the grade.

41. The method of claim 37, wherein the inputting of test data and the inputting of reference data comprises entering such data into respective input locations of a computerized data entry table.

42. The method of claim 41, wherein the graphical presentation is integrated with the computerized data entry table.

43. One or more computer readable media including machine-readable instructions for implementing the method of claim 37.

44. A module including logic configured to implement the method of claim 37.

* * * * *